United States Patent [19]

Hufton

[11] 4,301,779

[45] Nov. 24, 1981

[54] ENGINE FUEL MIXTURE CONTROL SYSTEM

[75] Inventor: Arthur G. Hufton, Mobile, Ala.

[73] Assignee: Teledyne Industries, Inc., Los Angeles, Calif.

[21] Appl. No.: 13,460

[22] Filed: Feb. 21, 1979

[51] Int. Cl.[3] ..... F02B 3/00

[52] U.S. Cl. ..... 123/478; 123/488; 123/487; 123/480

[58] Field of Search ..... 123/32 EA, 117 R, 32 EB, 123/32 EC, 32 ED, 119 R, 148 E

[56] References Cited

U.S. PATENT DOCUMENTS

| | | | |
|---|---|---|---|
| 2,933,135 | 1/1976 | Zillman et al. | 123/32 EA |
| 3,749,073 | 7/1973 | Asplund | 123/117 R |
| 3,908,616 | 9/1975 | Sasayama | 123/32 EC |
| 3,935,845 | 2/1976 | Aono et al. | 123/117 R |
| 4,048,964 | 9/1977 | Kissel | 123/32 EA |
| 4,050,878 | 9/1977 | Priegel | 123/32 EA |
| 4,083,347 | 4/1978 | Grather et al. | 123/148 E |
| 4,122,811 | 10/1978 | Bowler et al. | 123/32 EB |
| 4,125,093 | 11/1978 | Platzer, Jr. | 123/32 EA |

*Primary Examiner*—P. S. Lall

*Attorney, Agent, or Firm*—Gifford, VanOphem, Sheridan & Sprinkle

[57] ABSTRACT

An internal combustion engine fuel mixture control system is provided for use with an engine having a fuel supply and an intake air supply connected to the engine wherein the fuel and air mix to provide a combustible fuel/air mixture for the combustion engine. A fuel flow sensor is connected to the fuel supply line for the engine while an air flow sensor is similarly connected to the air intake of the engine and the outputs from the sensors are fed to a proportionator which provides an output signal representative of the instant fuel/air ratio for the engine and this output is coupled to one input of a differential amplifier. The other input of the differential amplifier is connected to a fuel/air ratio reference so that the output from the differential amplifier is representative of the difference between the reference and the actual fuel/air ratio for the engine. The output fromm the differential amplifier is used to vary the fuel flow to the engine.

9 Claims, 3 Drawing Figures

ENGINE FUEL MIXTURE CONTROL SYSTEM

BACKGROUND OF THE INVENTION

I. Field of the Invention

The present invention relates to an electronic fuel mixture control system.

II. Description of the Prior Art

The need to reduce fuel consumption while maintaining or even increasing engine performance is well recognized in the art of internal combustion engines both from a standpoint of fuel conservation and also in the reduction of operating costs. Maximum engine efficiency requires also that the fuel/air ratio for the internal combustion engine be controlled as a function of the actual or desired operating conditions.

For example, in aircraft engines a different fuel/air ratio would be required for aircraft takeoff than would be required for on ground taxiing of the aircraft due to the different power requirements for these different aircraft functions. Consequently, it has been the previous practice for aircraft pilots to frequently adjust their controls in an effort to obtain optimum engine performance and economy at all power settings for the aircraft. Moreover, such settings would vary from one altitude or atmospheric pressure due to the different air densities so that the previously known manual pilot adjustments of the fuel/air ratio have, at best, provided only a crude estimation as to the required fuel/air ratio for optimum engine performance. As a result, the previously known aircraft engines are operated at less than optimum performance and economy.

SUMMARY OF THE PRESENT INVENTION

The present invention overcomes the above mentioned disadvantages of the previously known aircraft fuel systems by providing an electronic fuel mixture control system which automatically controls the fuel/air ratio for the internal combustion engine for both maximum engine efficiency and economy.

In brief, the present invention includes a fuel flow sensor positioned in the fuel line between the fuel supply and the engine and an air flow sensor operatively coupled with the air intake means for the engine. The outputs from the sensors are connected to a proportionator which provides an output signal representative of the actual fuel/air ratio instantaneously supplied to the internal combustion engine. The output from the proportionator in turn is fed to one input of a differential amplifier.

A fuel/air ratio reference is connected to the other input of the differential amplifier so that the output from the differential amplifer is representative of the difference between the reference and actual fuel/air ratio for the engine. The output from the differential amplifier in turn is connected to and up/down counter which counts in a first direction when the differential amplifier output is greater than a predetermined value and conversely, counts in the opposite direction when the output from the differential amplifier is less than the predetermined value. When the differential amplifier output equals the predetermined value, as would occur in a case when the actual fuel/air ratio is equal to the reference to fuel/air ratio, the counter is disabled or in effect frozen at its instantaneous count.

The output from the up/down counter is in turn connected to a controller which generates an analog signal representative of the count in the counter. This analog signal is connected to a variable valve means fluidly connected in the fuel supply line to the internal combustion engine to vary the fuel flow to the engine until the actual fuel/air ratio equals the reference fuel/air ratio. The variable valve means can conveniently comprise a variable orifice rod in the carburetor or fuel injection means the axial position of which varies the fluid flow rate through the orifice.

As will become hereinafter more clearly apparent, in one form of the invention the fuel/air reference is varied between preset and predetermined values which are dependent upon the throttle position.

In a further form of the invention, however, the fuel/air reference is switchable between a minimum and maximum permissible fuel/air ratio. Thus, when the variable fuel-air reference is switched from one extreme to the other, the differential amplifier output is accordingly switched to activate the variable valve means to vary the actual fuel/air ratio toward the variable fuel/air reference.

Simultaneously, an engine performance sensor, which can, for example, comprise a sensor which detects the engine power, manifold pressure, or other similar variables indicative of engine performance, is provided and has its output connected to a slope detector. In the well known fashion, the slope detector generates an output indicative of the slope of the engine performance curve as measured by the engine performance sensor.

When the output from the engine performance sensor reaches either a maximum or a minimum, indicative of maximum engine performance and efficiency, the slope detector detects a zero slope and generates a signal which disables the differential amplifier and freezes the count in the counter. The engine performance slope detector in conjunction with a slope detector connected with the fuel flow sensor are provided as input variables to the fuel/air ration variable reference to control which extreme value the variable reference transmits to the differential amplifier.

DESCRIPTION OF THE DRAWINGS

The present invention will be more clearly understood upon reference to the following detailed description when read in conjunction with the accompanying drawing, wherein like reference characters refer to like parts throughout the several views, and in which.

DETAILED DESCRIPTION OF THE PRESENT INVENTION

Figure 1:
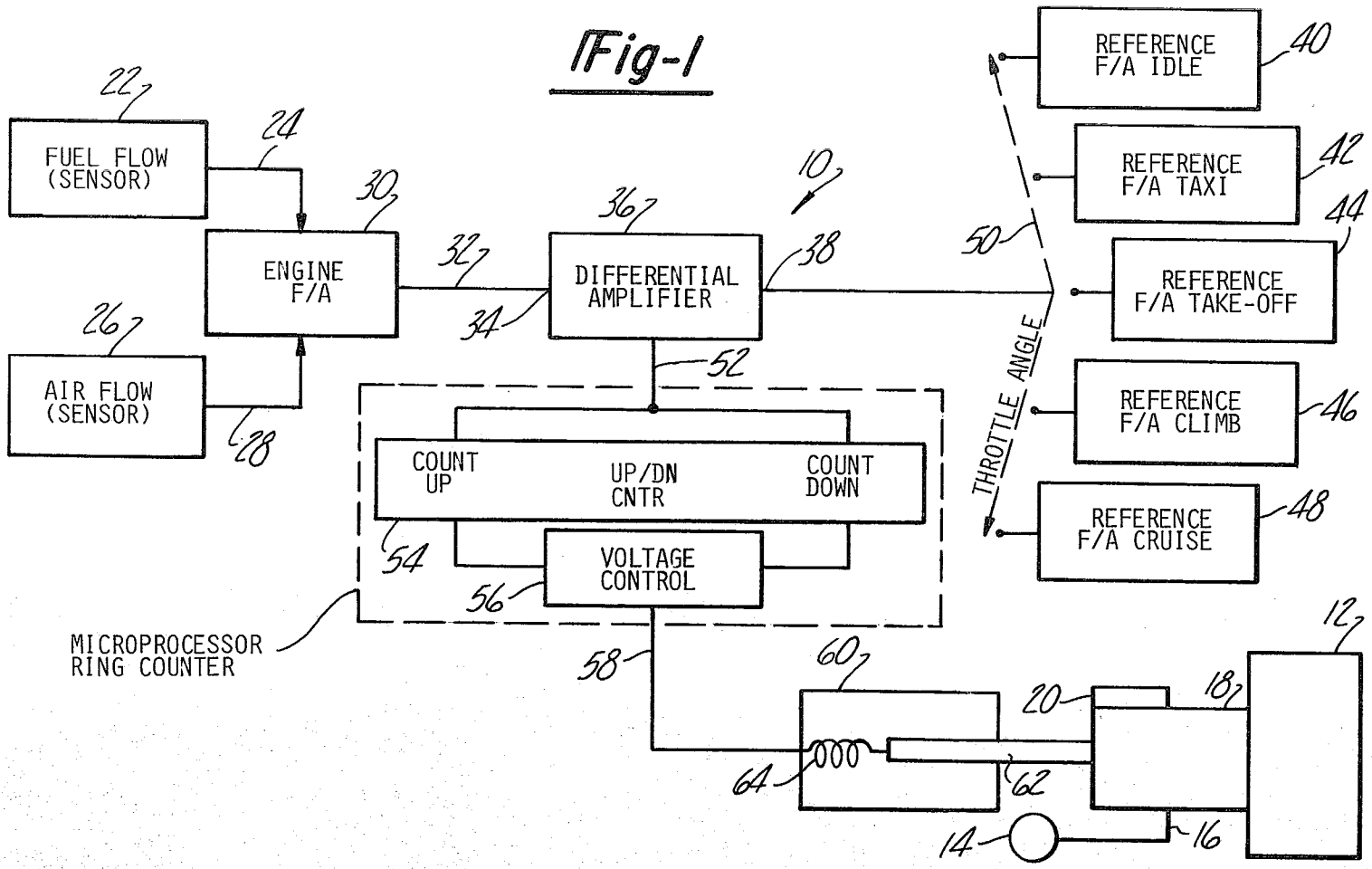
FIG. 1 is a block diagrammatic view illustrating the electronic fuel mixture control system according to the present invention.

With reference first to FIG. 1, an electronic fuel mixture control system 10 according to the present invention is thereshown for use with an internal combustion engine 12, illustrated only diagrammatically, such as an aircraft engine. In the conventional fashion an air intake means 20 and a fuel supply 14 via a fuel line 16 are connected to a fuel/air mixing means 18 which produces a combustible fuel/air mixture to the internal combustion engine 12. The fuel/air mixing means 18 can, for example, comprise a carburetor, a fuel injection means, or other well known and conventional devices so that further description thereof is not necessary.

As will become hereinafter more clearly apparent, the mixture control system 10 according to the present invention measures and computes the actual fuel/air ratio for the combustible charge supplied to the internal combustion engine 12 and compares this actual fuel/air ratio against a reference fuel/air ratio. To achieve this, a fuel sensor 22 is fluidly connected in the fuel line 16 and generates a signal on its output 24 representative of the fuel flow rate through the fuel flow line 16 and thus, to the internal combustion engine 12. The fuel sensor 22 can generate either a digitial or analog signal but, in the preferred form of the invention, generates an analog signal on its output 24.

Similarly, an air flow sensor 26 is connected to the air intake means 20 and generates a signal on its output 28 representative of the air flow rate through the air intake means 20. The air flow sensor can generate either a digital or analog signal provided the signal is compatible with the output signal from the fuel flow sensor 24.

The outputs 24 and 28 from the fuel flow sensor 22 and air flow sensor 26, respectively, are fed as input signals to a proportionator 30 which generates a preferably analog signal on its output 32 representative of the actual fuel/air ratio instantaneously supplied to the internal combustion engine 12. The proportionator output 32 is connected to one input 34 of a differential amplifier 36.

A reference fuel/air ratio is connected to the other input 38 of the differential amplifier 36 and, for the purpose of description only, it will be assumed that the internal combustion engine 12 is an aircraft engine, it being understood, of course, that the fuel mixture control system 10 of the present invention can be also employed for other types of internal combustion engines.

As illustrated in FIG. 1, the reference fuel/air ratio comprises a plurality of different reference values 40, 42, 44, 46 and 48, each reference value 40–48 being representative of a different engine condition. For example, the fuel/air reference value 40 can be indicative of an engine idling condition, the fuel/air reference value 42 representative of a taxiing condition, the fuel/air reference value 44 representative of an engine take-off condition while the reference values 46 and 48 represent an aircraft climb condition and cruise condition, respectively. The fuel/air reference value will vary from one engine condition to another.

The reference fuel/air ratios 40–48 are selectively and independently connected to the second input 38 of the differential amplifier 36 via a throttle control means 50. As is conventional in aircraft engines, the position of the throttle will vary in dependence upon the engine condition or requirements.

The differential amplifier 36 compares the input signals 34 and 38 from the actual fuel/air ratio and the reference fuel/air ratio, respectively, and generates an analog signal at its output 52 representative of the difference between the actual and reference fuel/air ratio. In the event that the actual fuel/air ratio exceeds the reference fuel/air ratio, the differential amplifier 36 generates a signal on its output 52 having a first polarity. Conversely, when the reference fuel/air ratio exceeds the actual fuel/air ratio, the differential amplifier output signal is of a second and opposite polarity. Finally, when the actual fuel/air ratio equals the reference fuel/air ratio, the differential amplifier 36 generates a zero signal on its output 52.

The output 52 from the differential amplifier 36 is connected to the control input of an up/down counter 54 which counts upward when the signal from the differential amplifier output 52 is of one polarity and counts in the opposite direction when the signal from the differential amplifier output 52 is of the opposite polarity. The up/down counter 54 does not count, and is in effect deactivated, when the differential amplifier output signal is zero.

The output from the up/down counter 54 is in turn connected as the input signal of a voltage controller 56. The voltage controller 56 can comprise, for example, a digital to analog (D/A) convertor and generates an analog signal on its output 58 representative of the count in the up/down counter 54. The voltage controller output 58 is connected to a voltage controlled variable valve means 60 fluidly connected in the fuel line 16 to the engine 12. Although the variable valve means 60 can comprise any conventional valve means, as illustrated, the valve means 60 comprises an orifice rod 62 which is axially slidably received in a fuel bypass passage in the fuel mixing means 18. The axial position of the rod 62 variably obstructs the fuel bypass orifice and thus, controls the fuel supply to the engine. The axial position of the rod 62 is controlled by coil means 64 connected to the controller output 58.

In operation, the actual fuel/air ratio is fed as an input 34 to the differential amplifier 36 while the reference fuel/air ratio is selectively connected to the second input 38 of the differential amplifier 36 via switch means 50 connected to the engine throttle control. In the event that the actual fuel/air ratio equals the reference fuel/air ratio, and thus provides optimum engine performance, the differential amplifier output 52 is zero so that the counter 54 is deactivated which maintains the orifice rod 62 in its present axial position. Conversely, in the event that the actual fuel/air ratio is either less than or greater than the reference fuel/air ratio, the differential amplifier generates an output signal which initiates the count in the counter 54 in a direction dependent upon the polarity of the differential amplifier output signal. As the count varies, the axial position of the orifice rod 62 via the controller 56 likewise changes to either increase or decrease the fuel supply to the engine 12 as required to bring the actual fuel/air ratio into conformity with the reference and thus optimum fuel/air ratio.

Figure 2:
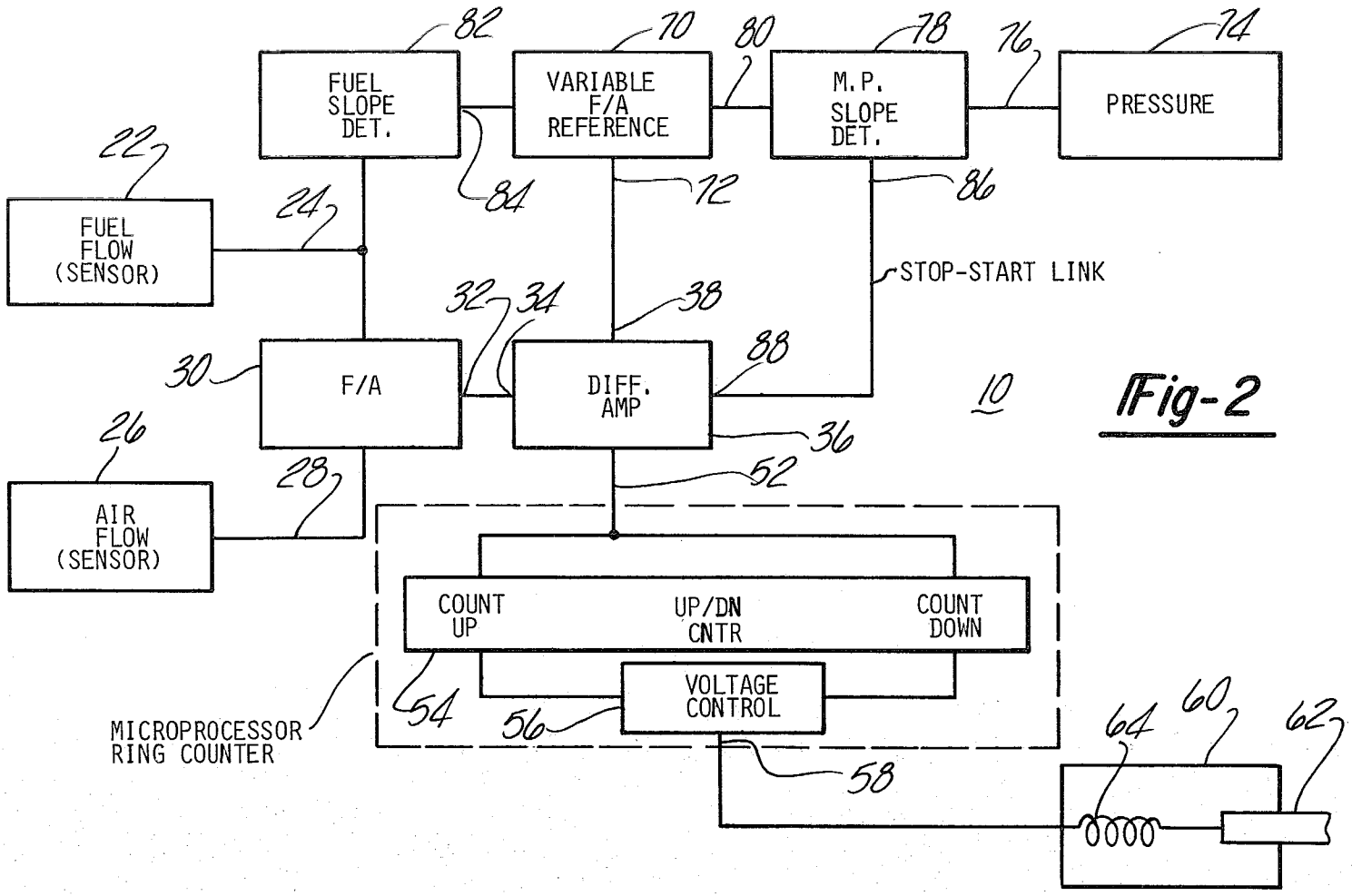
FIG. 2 is a block diagrammatic view similar to FIG. 1, but showing a modification thereof.

With reference now to FIG. 2, a modification of the present invention is there shown in which a variable fuel/air reference 70 having an output 72 connected to the second differential amplifier input 38 replaces the preset fuel/air reference values 40–48 (FIG. 1). The variable fuel/air reference 70 is switchable between a maximum permissible fuel/air ratio and a minimum permissible fuel/air ratio. Consequently, when the variable reference 70 is switched, in a fashion which will be shortly described, to its maximum value, the differential amplifier 36 will generate a signal on its output 52 which increases the fuel supply to the internal combustion engine 12. Conversely, when the variable reference 70 is switched to its minimum value, the differential amplifier 36 will generate an output signal which reduces the fuel supply to the engine 12.

The activation of the variable reference 70 is controlled in part by an engine performance sensor 74 which generates a signal on its output 76 representative of the engine performance. The sensor 74 can, for example, comprise a manifold pressure sensor the minimization of which is indicative of optimum engine performance. Similarly, the sensor 74 can comprise a horsepower sensor operatively connected to the engine 12 and the maximization of which is indicative of optimum engine performance or an exhaust hydrocarbon sensor the minimization of which is indicative of optimum engine performance. It will be understood, of course, that there are many other engine parameters which are measurable and indicative of engine performance.

The sensor output 76 is fed as an input to a slope detector 78 which generates a signal on its output 80 representative of the rate of change of the sensor output 76, i.e. the slope of a curve following the output 76 from the performance sensor 74. The output 80 of the slope detector 78 is fed as an input to the variable fuel/air reference 70. A second slope detector 82 is connected to the output from the fuel flow sensor 22 and generates a signal on its output 84 indicative of the slope of the fuel flow rate through the fuel line. The second slope detector output 84 is also fed to the variable fuel/air reference 70 and, in conjunction with the output 80 from the first slope detector 78 determines whether the variable fuel/air reference 70 is switched to its maximum or minimum value.

The first slope detector 78 also includes a further output 86 connected to a disable input 88 on the differential amplifier 36. Thus, when the output from the performance sensor reaches either a maximum or minimum so that its slope is zero, the slope detector 78 generates a disable signal along its second output 86 which disables the differential amplifier 36 and stops the count in the counter 54.

In operation, when the variable reference 70 is switched to either its maximum value or its minimum value, the system 10 will automatically begin searching in the direction of the variable reference 70 for the maximum engine performance. When the maximum engine performance is achieved, as indicated by either a minimum or maximum of the engine performance sensor 74, the differential amplifier 36, and thus the counter 54 and the variable valve means 60, is deactivated or frozen at its instantaneous position.

Figure 3:
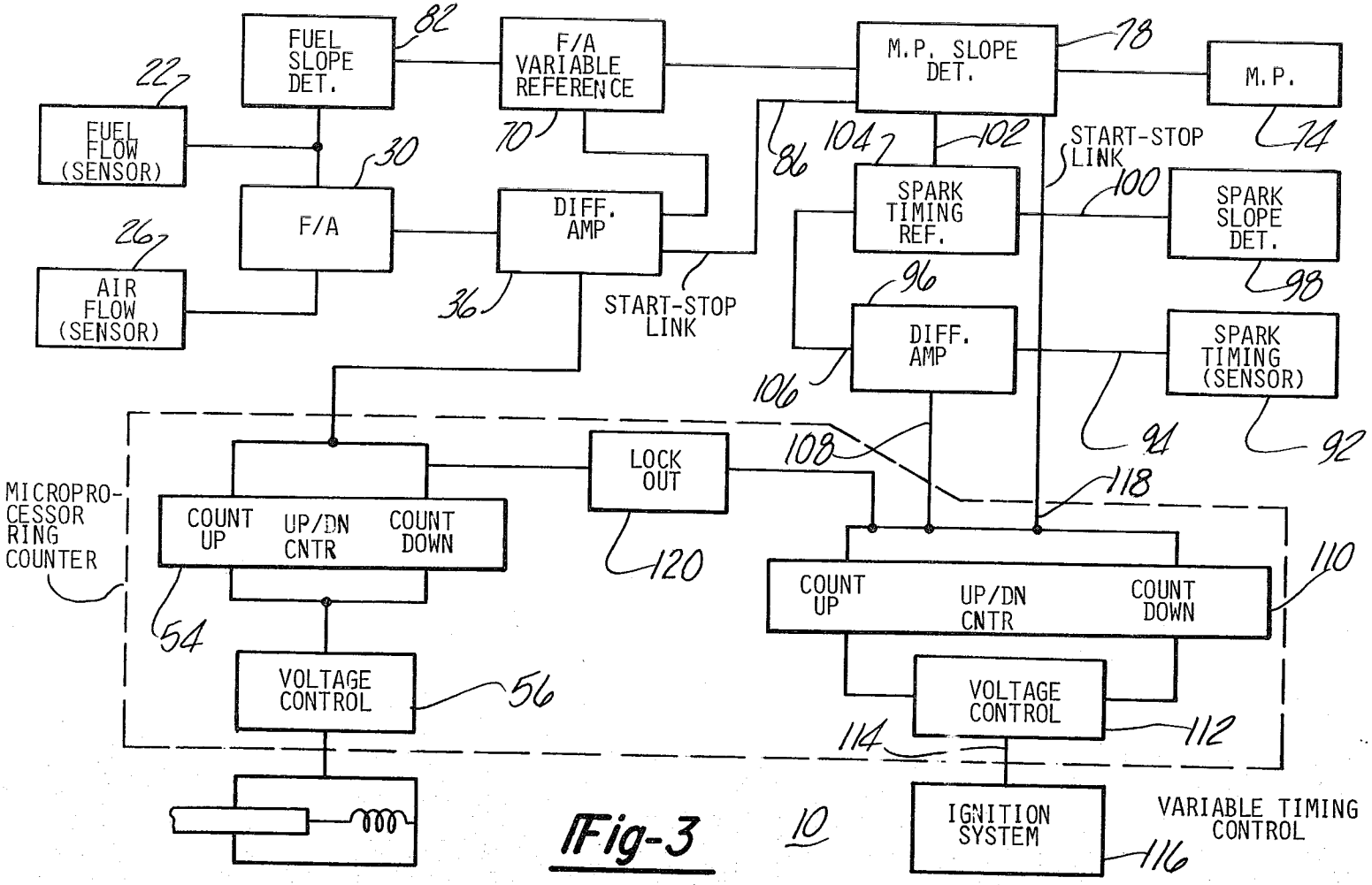
FIG. 3 is a block diagrammatic view similar to both FIGS. 1 and 2, but showing a still further modification thereof.

With reference now to FIG. 3, a still further modification of the system 10 of the present invention is thereshown which is similar to the system depicted in FIG. 2 but which further includes means 90 for varying the timing of the ignition system for maximum engine performance. Since the portion of the system shown in FIG. 3 for controlling the fuel/air ratio is substantially the same as FIG. 2, it will be understood that the previous description of FIG. 2 is equally applicable for the like system components in FIG. 3 so that unnecessary repetition will be avoided.

A spark timing sensor 92 is connected to the ignition system of the engine 12 and generates a signal on its output 94 representative of the ignition timing. The sensor output 94 is connected as an input to both a second differential amplifier 96 and a further slope detector 98. The slope detector 98 like the detector 78 generates a signal on its output 100 representative of the rate of change or slope of the spark timing sensor output.

The detector output 100 is coupled as a control input in conjunction with an input 102 to a spark timing reference 104 switchable between a maximum and minimum permissible value. The output from the spark timing reference, in turn, is fed as the other input 106 to the differential amplifier 96 which generates a signal on its output 108 representative of the difference between the actual spark timing signal and the reference signal.

The output 108 from the differential amplifier 96 in turn is connected to the input of a further up/down counter 110 which counts in a first direction when the diffential amplifier output-signal 108 is of one polarity, counts in the opposite direction for the opposite polarity and is frozen or deactivated when the amplifier output signal is zero. The up-down counter 110 output is connected to a further voltage controller 112 similar to the voltage controller 56 and generates an analog signal on its output 114 to a variable timing control 116. The timing control 116, for example, can be an electric mechanical servomechanism.

The detector 78 also includes a second output 118 which, like the output 86, generates an output signal when the slope of the engine performance sensor 74 is zero, i.e. at optimum engine performance. The output 118 is connected to the up/down counter 110 or, alternatively, to the differential amplifier 96 to deactivate the variable timing control 116 when maximum engine performance is achieved.

The operation of the timing control 90 is substantially the same as the fuel/air ratio control. In brief, however, the spark timing reference is switched either to its minimum or maximum value in dependence upon the input from the differentiating amplifiers 98 and 78 which initiates a search of the variable timing control toward the selected minimum or maximum from the timing reference 104. When the engine 12 achieves maximum performance, as determined by the performance sensor 94, the slope detector 78 deactivates the timing control system 90 via its output 118 thus freezing the spark timing at its adjusted position. In addition, a lockout means 120 is preferably connected between the counters 54 and 110 to selectively deactivate one counter or the other in order to prevent unwanted simultaneous adjustment of two independent variables, i.e. ignition timing and the fuel/air ratio.

From the foregoing it can be seen that the electronic fuel mixture control system 10 of the present invention provides a simple but totally effective means for achieving maximum engine performance in the internal combustion engine. Moreover, the fuel mixture control system of the present invention automatically compensates for atmospheric conditions thus obviating the previously known manual fuel and throttle compensation of the previously known combustion engines.

Having described my invention, however, many modifications thereto will become apparent to those skilled in the art to which it pertains without deviation from the spirit of the invention as defined by the scope of the appended claims.

I claim:

1. In an internal combustion engine having a fuel supply connected to said engine by a fuel line, a valve means connected in said fuel line for regulating the fuel flow to said engine, and an air intake means, said air mixing with said fuel to provide a combustible charge for the engine, a fuel mixture control system comprises:

a fuel flow meter connected in said fuel line, said fuel flow meter providing an output signal representative of the fluid flow rate through the fuel line;

an air flow meter connected to the air intake means, said air flow meter providing an output signal representative of the air flow rate into the engine;

proportioning means connected to the outputs from said flow meters for providing an output signal representative of the fuel/air ratio for the engine;

a reference fuel/air ratio means for providing an output signal representative of the optimum engine fuel/air ratio for a given engine condition;

means for comparing said reference means output with said proportioning means output and producing an output signal representative of the difference therebetween; and means responsive to said comparing means output signal for controlling said fuel valve means so that said comparing means output attains said reference output wherein said reference means further comprises a variable fuel/air reference means having its output connected to the comparing means, said variable reference means being switchable between a high level in which the output to the comparing means is representative of maximum permissible engine fuel/air ratio and a low level in which the output to the comparing means is representative of the minimum permissible engine fuel/air ratio, and sensor means having an output and responsive to a parameter representative of engine performance, first detector means for determining the slope of said engine performance parameter, second detector means for determining the slope of the engine fuel-/air ratio, said first and second detector means having outputs connected to and controlling the level of the variable reference means, and means for disabling said responsive means when the first detector means output is substantially zero.

2. The invention as defined in claim 1 wherein said valve controlling means further comprises an up/down counter, said counter counting in a first direction when the comparing means output exceeds a predetermined value and counting in the opposite direction when said comparing means output is less than the predetermined value, and means responsive to the count in the counter for controlling the degree of actuation of the valve means.

3. The invention as defined in claim 1 wherein said comparing means is a differential amplifier.

4. The invention as defined in claim 1 wherein said engine includes an intake manifold and wherein said engine variable is the manifold pressure, said sensor means comprising a pressure transducer.

5. The invention as defined in claim 1 wherein said engine performance variable is the engine power and wherein said sensor means comprises a power transducer.

6. The invention as defined in claim 1 wherein said internal combustion engine includes a spark ignition means and variable timing means for said spark ignition means, said system further comprising means responsive to the first detector means for controlling the variable timing means, and means for disabling said variable timing control means when said output from said first detector means is substantially zero.

7. The invention as defined in claim 5 wherein said timing control means further comprises a variable timing reference switchable between a high level representative of maximum permissible spark advance and a low level representative of maximum permissible spark retardation, said variable reference means having an output connected to a further comparing means, a spark timing sensor means having an output connected to an input of said comparing means, and means responsive to said further comparing means for controlling the actuation of said variable timing means.

8. The invention as defined in claim 6 wherein said means for controlling the variable timing means further comprises an up/down counter which counts in a first direction when the further comparing means output is greater than a predetermined value and which counts in the opposite direction when said comparing means output is less than said predetermined value, and means responsive to the count in the counter for controlling the actuation of the variable timing means.

9. In an internal combustion engine having a fuel supply connected to said engine by a fuel line, a valve means connected in said fuel line for regulating the fuel flow to said engine, and an air intake means, said air mixing with said fuel to provide a combustible charge for the engine, fuel mixture control system comprises:

a fuel flow meter connected in said fuel line, said fuel flow meter providing an output signal representative of the fluid flow rate through the fuel line;

an air flow meter connected to the air intake means, said air flow meter providing an output signal representative of the air flow rate into the engine;

proportioning means connected to the outputs from said flow meters for providing an output signal representative to the fuel/air ratio for the engine;

a reference fuel/air ratio means for providing an output signal representative of the optimum engine fuel/air ratio for a given engine condition;

means for comparing said reference means output with said proportioning means output and producing an output signal representative of the difference therebetween; and means responsive to said comparing means output signal for controlling said fuel valve means so that said proportioning means output attains said reference output;

wherein said engine includes a throttle means movable between a plurality of operating positions, each throttle position being representative of one or more distinct engine conditions, said reference means further comprising a plurality of reference value wherein each reference value is a signal representative of the optimum engine fuel/air ratio for one distinct engine condition, and switch means connected to said throttle means for selectively electrically connecting only one of said reference values to said comparing means at each operating position of said throttle means.

* * * * *

UNITED STATES PATENT AND TRADEMARK OFFICE

CERTIFICATE OF CORRECTION

PATENT NO. : 4,301,779

DATED : November 24, 1981

INVENTOR(S) : Arthur G. Hufton

It is certified that error appears in the above-identified patent and that said Letters Patent are hereby corrected as shown below:

In the Abstract, line 16, delete "fromm" and insert --from-- therefor.

Column 6, line 11, delete "up-down" and insert --up/down-- therefor.

Column 8, line 11, after "said", insert --further--.

Signed and Sealed this

Sixth Day of April 1982

[SEAL]

Attest:

GERALD J. MOSSINGHOFF

Attesting Officer

Commissioner of Patents and Trademarks